US006962160B2

(12) United States Patent
Dumler

(10) Patent No.: US 6,962,160 B2
(45) Date of Patent: Nov. 8, 2005

(54) MASCARA BRUSH

(75) Inventor: Norbert Dumler, Ansbach (DE)

(73) Assignee: Geka Brush GmbH, Bechhofen (DE)

( * ) Notice: Subject to any disclaimer, the term of this patent is extended or adjusted under 35 U.S.C. 154(b) by 124 days.

(21) Appl. No.: 10/259,455

(22) Filed: Sep. 30, 2002

(65) Prior Publication Data

US 2004/0011375 A1 Jan. 22, 2004

(30) Foreign Application Priority Data

Jul. 18, 2002 (DE) ..... 102 32 589

(51) Int. Cl.[7] ..... A45D 4/26
(52) U.S. Cl. ..... 132/218
(58) Field of Search ..... 132/218, 317, 132/320, 313; 15/167.1, 207.2, 159.1; 428/372, 400, 399

(56) References Cited

U.S. PATENT DOCUMENTS 2,110,371 A * 3/1938 Radford ..... 428/375
2,225,331 A * 12/1940 Campbell ..... 15/188
2,365,396 A 12/1944 Cunningham
2,426,328 A * 8/1947 Wandel et al. ..... 300/21
3,497,900 A * 3/1970 Kutik et al. ..... 15/104.93
3,706,111 A * 12/1972 Curtin et al. ..... 15/159
4,373,541 A * 2/1983 Nishioka ..... 15/167.1
4,964,429 A 10/1990 Cole
5,176,427 A * 1/1993 Weihrauch ..... 300/10
5,613,258 A * 3/1997 Hilfinger et al. ..... 15/22.1
6,012,465 A 1/2000 Gueret
6,258,044 B1 * 7/2001 Lonky et al. ..... 600/569
6,311,359 B1 * 11/2001 Brezler ..... 15/159.1
6,322,152 B2 * 11/2001 Trojanowski et al. ..... 300/21
6,546,586 B2 * 4/2003 Cho ..... 15/167.1

FOREIGN PATENT DOCUMENTS

JP 2000270928 10/2000

* cited by examiner

*Primary Examiner*—John J. Wilson
*Assistant Examiner*—Robyn Doan
(74) *Attorney, Agent, or Firm*—Browdy and Neimark, PLLC

(57) ABSTRACT

A mascara brush serves to apply a mascara mass onto the eyelashes. It comprises a plurality of bristles that are secured between two twisted wire segments and extend out from the wire segments. The free ends of the bristles are tapered wedge-shaped in cross section. This serves to improve the combing result of the mascara brush.

16 Claims, 8 Drawing Sheets

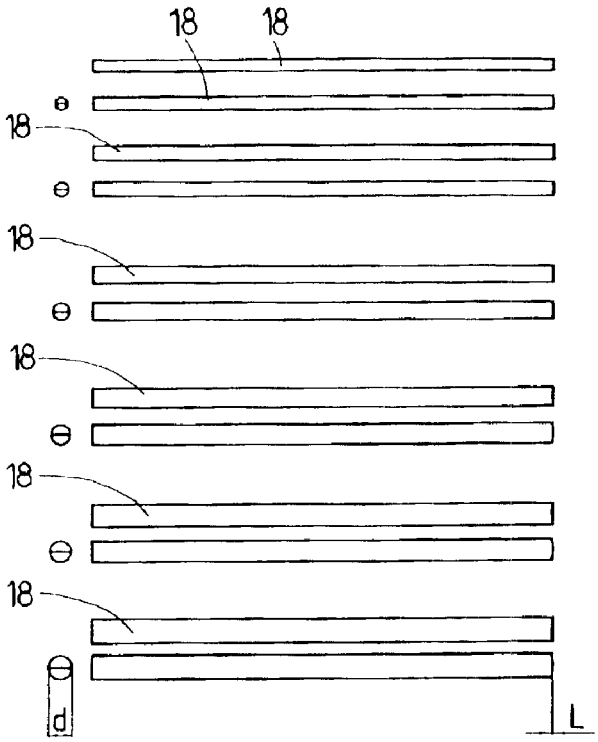
FIG. 16
FIG. 17
FIG. 18
FIG. 19
FIG. 20
FIG. 21
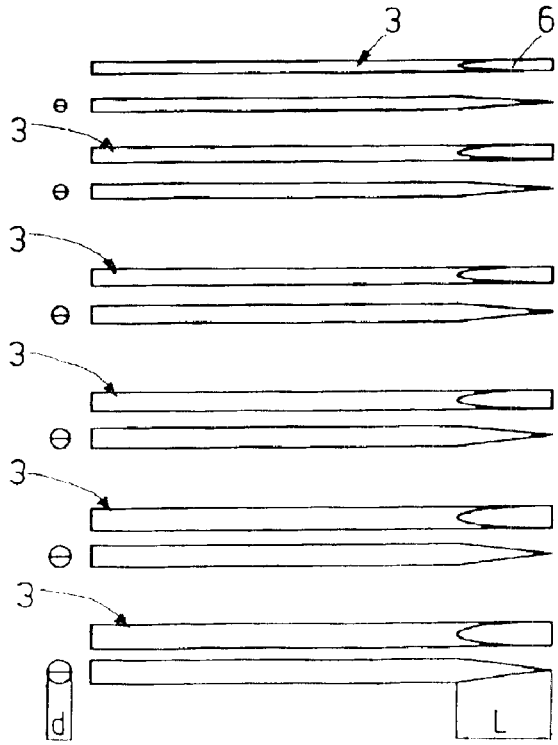
FIG. 22
FIG. 23
FIG. 24
FIG. 25
FIG. 26
FIG. 27

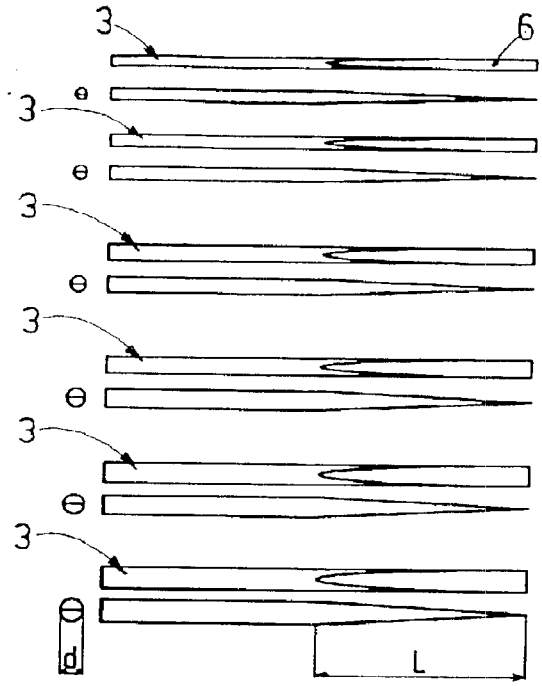
FIG. 28
FIG. 29
FIG. 30
FIG. 31
FIG. 32
FIG. 33
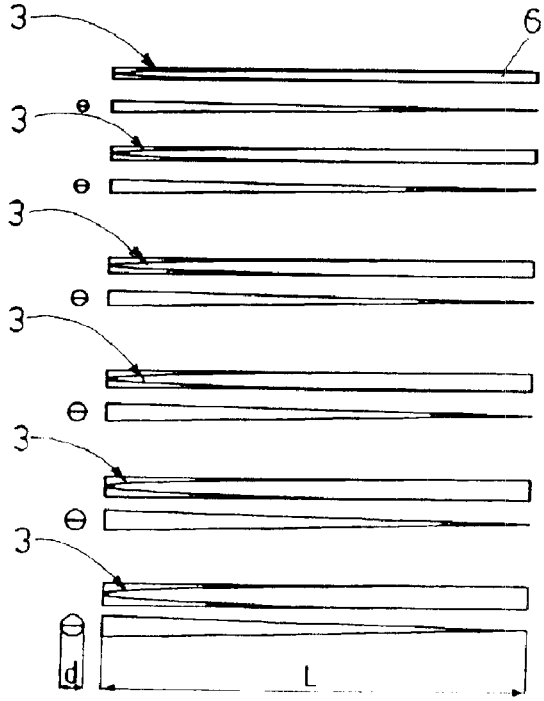
FIG. 34
FIG. 35
FIG. 36
FIG. 37
FIG. 38
FIG. 39

MASCARA BRUSH

BACKGROUND OF THE INVENTION

1. Field of the Invention

The present invention is concerned with a mascara brush for applying a mascara mass onto the eyelashes, comprising a plurality of bristles secured between two twisted wire segments and extending out from the same, the free ends of which are executed tapered.

2. Background Art

A mascara brush of this type is known on the market. There, the free bristle ends are present in the form of tips. While it is true that bristle tips of that kind can easily penetrate into the spaces between individual eyelashes, which is a prerequisite for a good combing result of the mascara brush, they possess insufficient stiffness. Therefore, when two eyelashes must be separated in the course of a mascara application, and a certain amount of resistance must be overcome in the process during the combing, the bristle ends often become bent and leave the space between these eyelashes without actually performing any combing action. If one uses brushes with stiffer, thicker bristles, these are too thick to penetrate into the spaces between closely spaced eyelashes.

SUMMARY OF THE INVENTION

It is therefore the object of the present invention to improve a mascara brush of the above type in such a way that the make-up result of a mascara application performed with the mascara brush is improved.

This object is met according to the invention with a mascara brush of the above type wherein the free ends of at least a portion of the bristles are executed wedge-shaped in cross section.

According to the invention it has been recognized that, in order to separate two adjacent eyelashes, it is sufficient to provide a silhouette of the bristles that tapers parallel to the combing direction. In the perpendicular direction, on the other hand, the cross section design of the bristles has no or only minor impact on the suitability of the bristles for separating the eyelashes. The inventive wedge-shaped bristles therefore combine the essentially contrasting properties of the good separation effect on one hand and the good stiffness required for combing on the other hand. Additionally, the wedge-shaped sharpened bristle tips provide a wider spacing from one another, into which the individual eyelashes can penetrate, especially in the case of brushes in which the bristle tips are evenly distributed over the brush surface.

Free ends of the mascara brush that have a roof or chisel-like configuration lead to the optimization of the property pair of a separation on the one hand and combing effect on the other hand. Alternately, free ends of the bristles that are wedge-shaped in cross section may be implemented also by bevelling the ends of the bristles.

The outer edges of the ends preferably extend approximately parallel to one another and approximately perpendicular to the twisted wires. This edge contour ensures that the silhouette of the bristle ends tapers in a wedge shape when the mascara is applied, as a result of which good combing properties result from the mascara brush with normal handling In an embodiment variation of the mascara brush, bristles of different lengths may be provided and only the ends of the longer bristles may be designed wedge-shaped in cross section. In addition to the longer bristles that have the above described advantages, the shorter bristles of this embodiment variation ensure a good cleaning and application effect of the mascara brush.

The ends of the bristles may be polished. Bristles of these types can be produced easily and inexpensively.

Bristle diameters in the range between 0.1 and 0.4 mm, wedge lengths between 0.5 mm and 15 mm, and angles β between the longitudinal axes of the bristles and longitudinal axis of the brush between 45° and 135° have proven particularly advantageous. In these parameter ranges an efficient combing effect can be attained with a simultaneous good cleaning and application effect of the mascara brush.

Embodiments of the invention will be explained in more detail below with the aid of the drawing.

Figure 1:
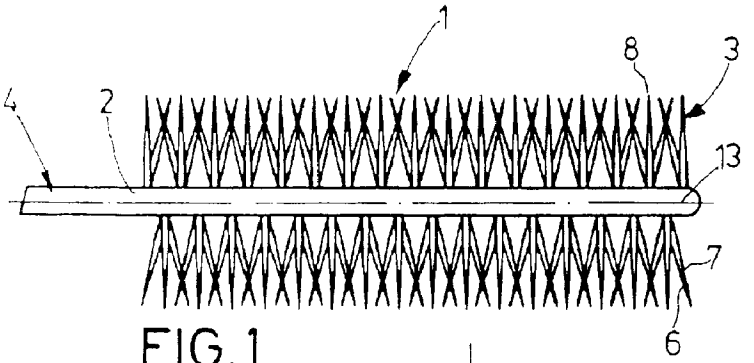
FIG. 1 shows a side view of an inventive mascara brush.
Figure 6:
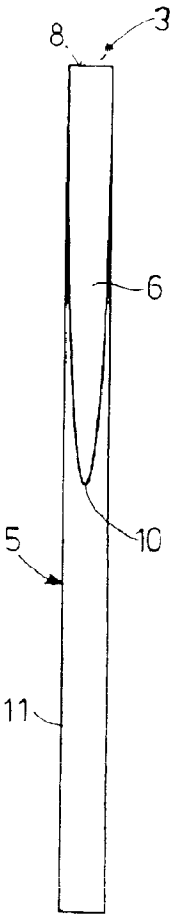
Figure 7:
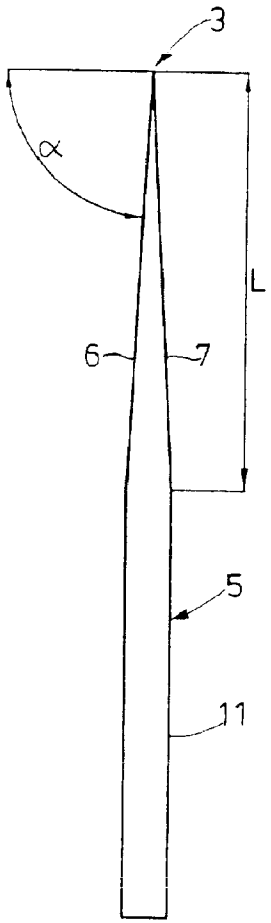
Figure 8:
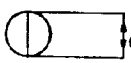

FIGSS. 4 and 5 are schematic top views of the eyelashes of an eyelid prior to and after a mascara application with the mascara brush of FIG. 1;

FIGS. 6 through 8 show three views of a bristle end section of the mascara brush of FIG. 1 in an enlarged scale.

Figure 3:
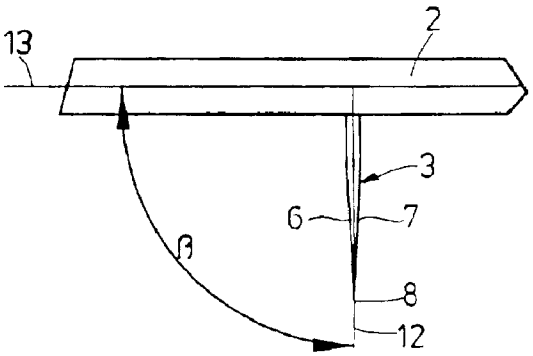
FIG. 3 shows a schematic detail section of the mascara brush of FIG. 1 in an enlarged scale.
Figure 12:
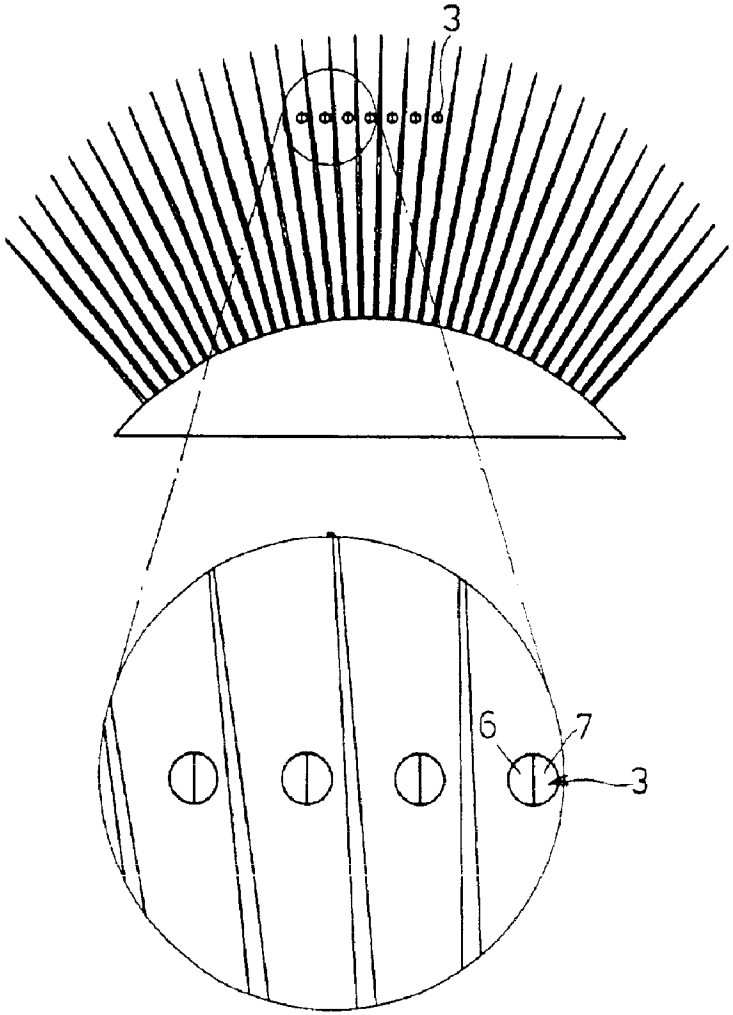
Figure 9:
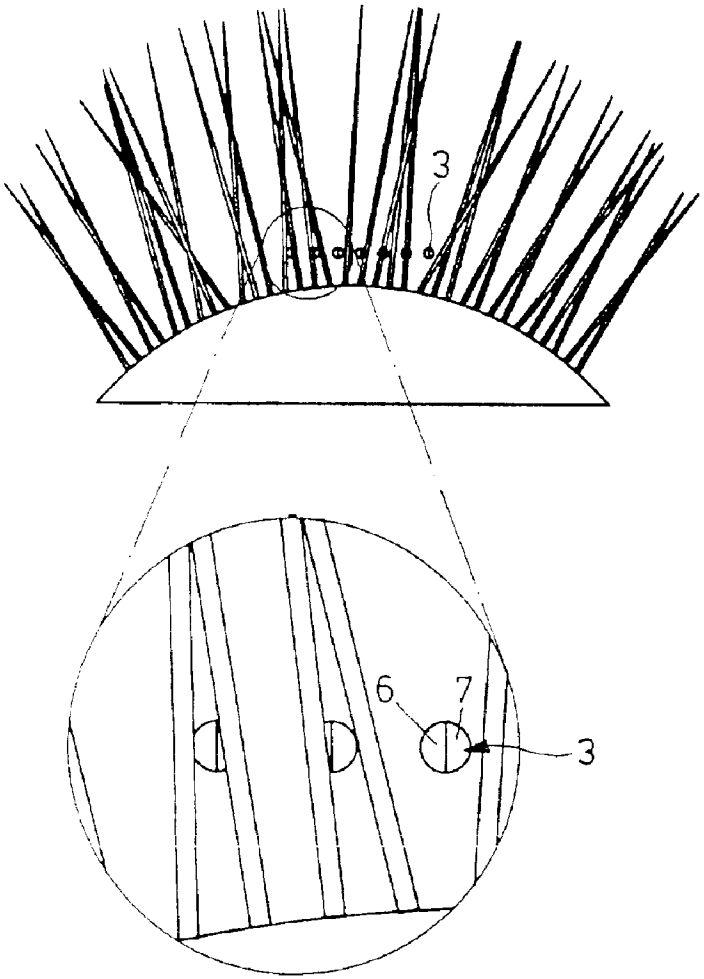
Figure 11:
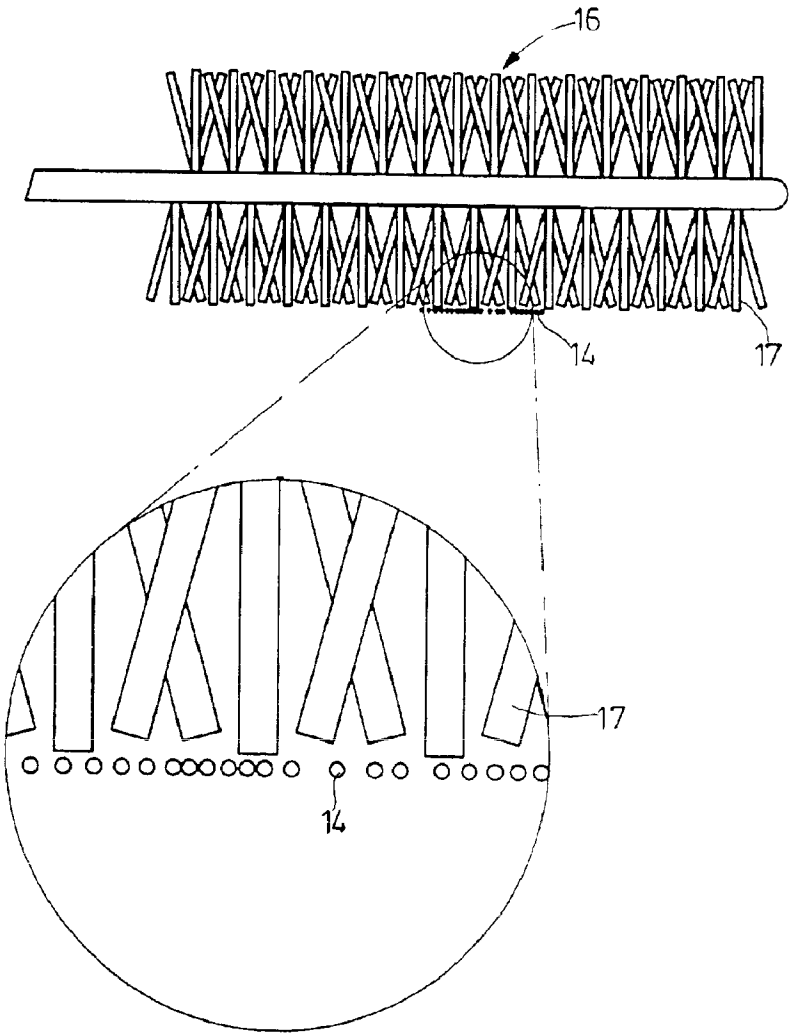
Figure 10:
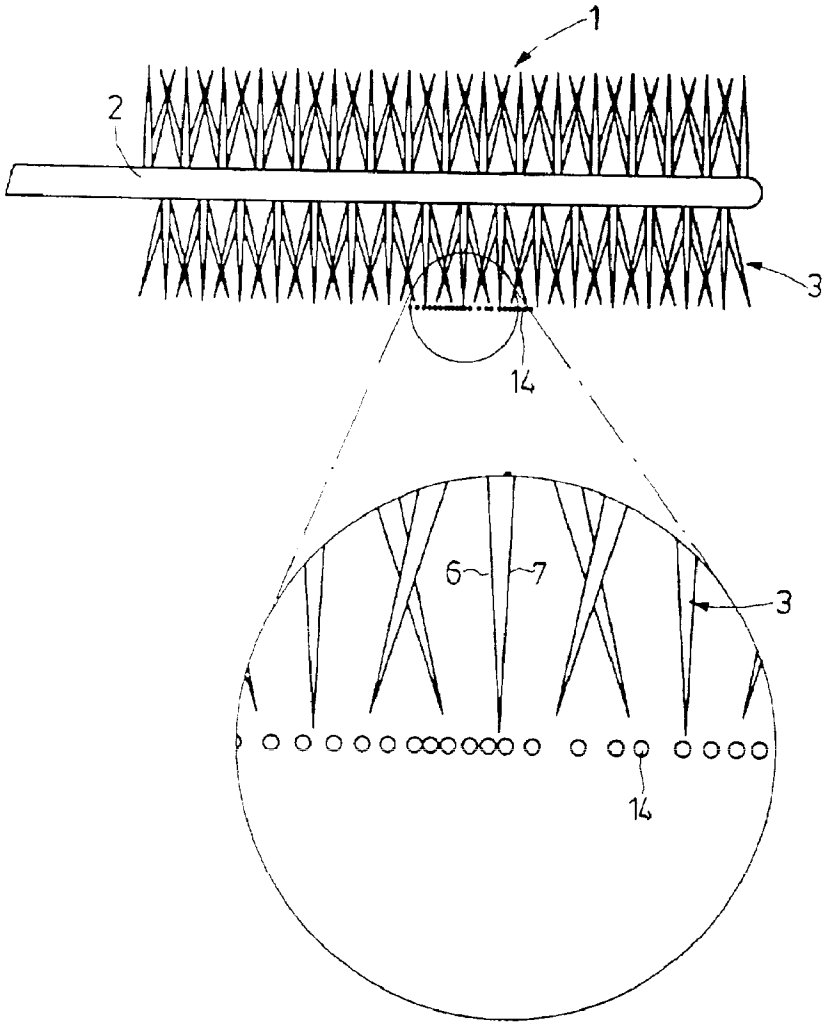
Figure 15:
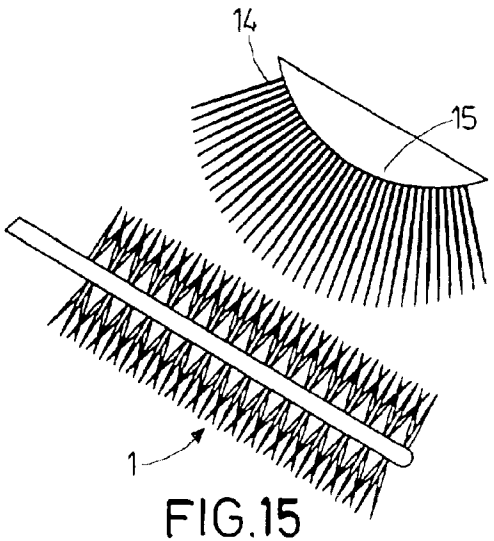
Figure 14:
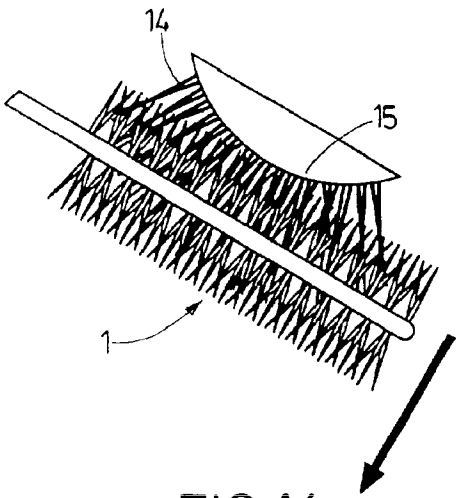
Figure 13:
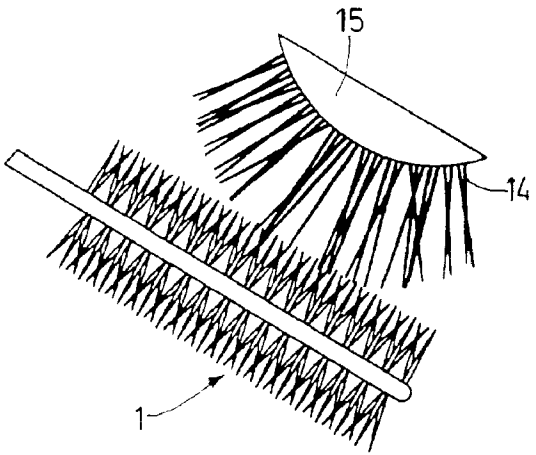
Figure 48:
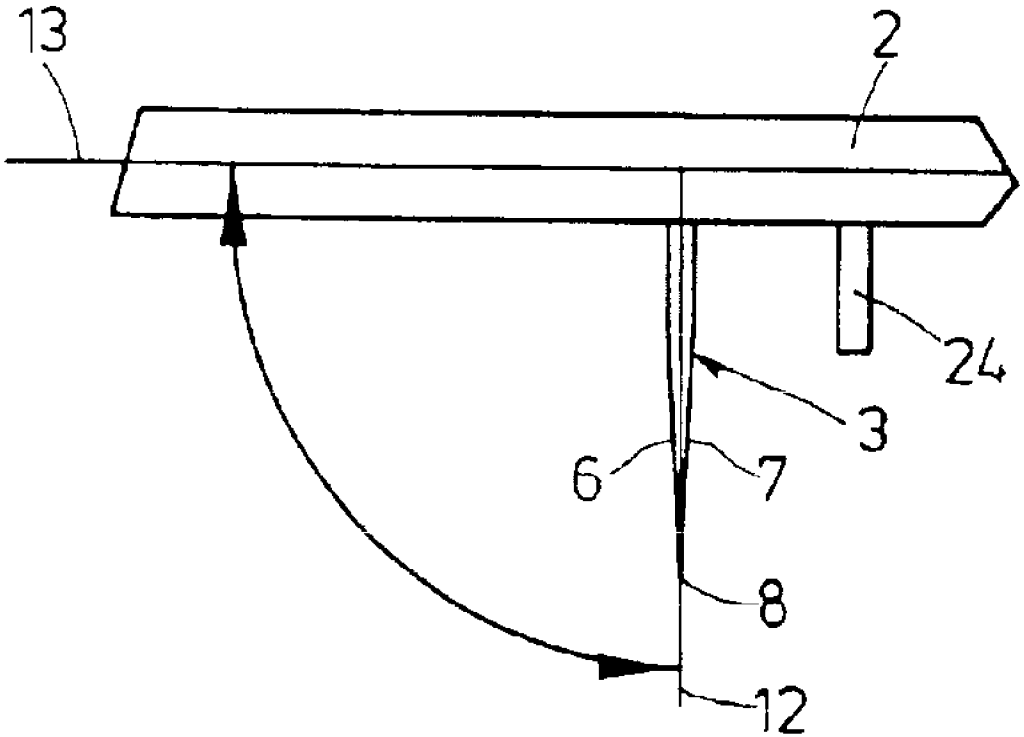

FIGS. 9 and 10 show two views of the eyelashes and mascara brush immediately prior to applying the mascara;

FIG. 11 shows an illustration corresponding to FIG. 10, which schematically depicts a mascara brush according to the prior art;

FIG. 12 shows a schematic illustration corresponding to FIG. 9 during the mascara application;

FIGS. 13 through 15 show three views of the inventive mascara brush in different stages of the mascara application process;

FIGS. 16 through 21 show pairs of bristle blanks of various diameters with a polished section length L=0;

FIGS. 22 through 39 shows pairs of bristle blanks of various diameters, however with an increasing polished section length L>0;

FIGS. 40 through 47 show sections through variations of inventive bristles; and FIG. 48 shows an illustration resembling FIG. 3 of a further variation of an inventive mascara brush.

DESCRIPTIONS OF THE PREFERRED EMBODIMENTS

Figure 2:
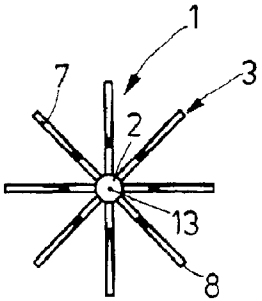
FIG. 2 shows a schematic view of a front end of the mascara brush of FIG. 1, viewed from the side facing away from the handle.

FIG. 1 shows an inventive mascara brush 1. A core 2 that has two wire segments, which are twisted in a known manner carries a plurality of bristles 3 that are secured between the wire segments. Possible materials for the bristles 3 are polyamide, polyester, acrylic, PET, natural hair, as well as plant fibers. As shown in FIG. 2, the bristles 3 extend radially outward relative to the longitudinal axis of the core 2. In FIG. 1 the core 2 is extended to the left towards a handle section 4 of which only a portion is shown.

FIGS. 6 and 7 show, in an enlarged scale, an end section 5 of a bristle 3 sticking out from the core 2. The free end of the end section 5 tapers in a wedge shape. This is achieved in such a way that the end section 5 has wedge surfaces 6 and 7 that are joined at the free end of the end section 5, like the ridge of a roof, in an end edge region 8. As becomes apparent from the combined view of FIGS. 6 and 7, the wedge-shaped tapered end section 5 of the tip resembles a clockmaker's screw driver. Together with a plane 9, which is perpendicular to both the drawing plane of FIG. 7 as well as to a center plane of the end section 5 perpendicular thereto, the wedge surfaces 6, 7, enclose a wedge angle $\alpha$ of 80°. The length L of the wedge, i.e., the length of the end section 5 between the end edge region 8 and an end region 10 in which the wedge surfaces 6, 7 open into an outer face 11 of the end section 5, is 2.5 mm. Outside the wedge region, the end section 5 has a cylindrical basic shape with a diameter d of 0.25 mm.

From FIG. 3 it becomes apparent that the longitudinal axis 12 of a bristle 3 together with the longitudinal axis 13 of the core 2, encompasses an angle $\beta$ of 90°. Along the longitudinal axis 13 of the core 2, a distribution of the angle $\beta$ may be present in the mascara brush 1 in an angle range of approximately 90°+/−45°.

Figure 4:
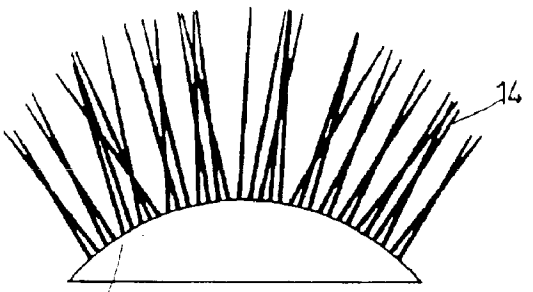

FIGS. 1 and 2 show that the ridges of the end edge regions 8 are situated perpendicular on the longitudinal axis 13 of the core 2. As becomes apparent from FIGS. 4, 5, 9 and 10, this orientation of the end edge regions 8 permits a defined engagement of the end edge regions 8 between adjacent eyelashes 14 that extend from an eyelid 15. In the lash root area adjoining the eyelid 15, the adjacent eyelashes 14 display a separation in the direction of the row of lashes, also in their uncombed condition. This separation becomes apparent, for example, in FIGS. 4 and 9. FIG. 9 additionally also shows that the bristles 3 of the mascara brush 1 have a thickness and distance from one another such that they can easily engage into this separation.

FIGS. 10 and 11 show, in a direct comparison, the difference in the separating and combing properties between the inventive mascara brush 1 and a mascara brush 16 according to the prior art with bristles 17 that do not taper to a point or wedge shape. The section enlargement in FIG. 10 shows that the end edge regions 8 of the bristles 3 of the inventive mascara brush 1 can also engage between closely spaced eyelashes 14. The bristles 17 of the mascara brush 16 according to the prior art, on the other hand, have a diameter also at the free end of their end sections, that is large compared to the spacing of the adjacent eyelashes 14. A separation of adjacent lashes 14 is therefore virtually impossible with the bristles 17 of the mascara brush 16 according to the prior art.

The function of the mascara brush 1 during the process of a mascara application will be described below with the aid of FIGS. 9 and 12 through 15:

FIG. 13 shows a stage in the mascara application in which the mascara brush 1 is moved near the eyelid 15 with the lashes 14, at first without coming into engagement with the lashes 14. The mascara brush 1 is then held in such a way that the end sections 5 of the bristles 3 engage into the spaces between the lashes 14 as close as possible to their points of origin. This position is shown in FIG. 9. The mascara brush 1 is then pulled away from the eyelid 15, during which process the bristles 3 remain in engagement with the lashes 14 and separate and comb the same. This pulling motion is preferably supported by a rotation of the mascara brush 1 around its longitudinal axis 13, with the direction of rotation being such that the side of the mascara brush 1 that is in engagement with the lashes 14 moves away from the points of origin of the lashes 14 on the eyelid 15 faster than the core 2. Alternately or additionally, an upward/forward motion may also support this pulling motion. An interim condition during this removal, during which the lashes 14 are already completely separated, is shown in FIG. 12. Due to the stiffness of the end sections 5 in the center plane parallel to the combing direction, they do not bend during the parting and combing of the lashes 14. FIG. 15 shows the stage during the mascara application process immediately after the mascara brush 1 is out of engagement, after the combing process, with the lashes 14 that are now combed.

Figure 5:
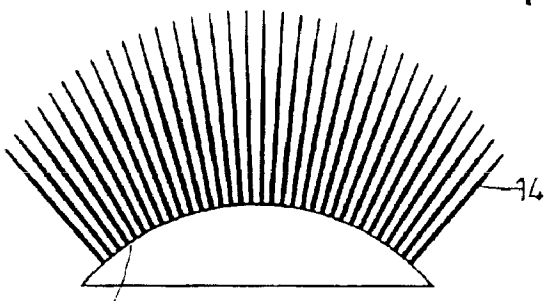

The separated and combed lashes 14 as the result of the mascara application process are shown in FIG. 5. The subjective impression of an elongation and increased volume of the lashes is created.

Additional embodiments of inventive mascara brushes are shown in FIGS. 16 through 48. Brush components that correspond to those that have already been described with reference to FIGS. 1 through 15 carry the same reference numerals and will not be explained again in detail.

FIGS. 16 and 21 show pairs of different variations of bristle blanks 18 as the starting product for producing the bristles 3. The diameter d of the bristle blanks 18 increases between FIGS. 16 and 21, starting from 0.1 mm in FIG. 16, to 0.4 mm in FIG. 21, without a wedge, or with a polished section length or wedge length L=0, respectively.

FIGS. 22 through 39 show different variations of end sections 5 of inventive bristles 3 with a diameter of 0.1 mm to 0.4 mm and increasing L. FIGS. 22 through 27, 28 through 33, as well as 34 through 39, show end sections 5 that have been produced from the respective bristle blanks 18 with their given diameters by polishing.

In the end sections 5 of the bristles 3 in FIGS. 22 through 27, the wedge length L is 1.5 mm. The wedge length L of the end sections 5 of the bristles 3 in FIGS. 28 through 33 is 3 mm, and that of the bristles 3 in FIGS. 34 through 39 is 6 mm. End sections 5 with shorter wedge lengths, for example 0.5 mm, and with longer wedge lengths, for example 15 mm, can be produced as well.

The wedge angles $\alpha$ of the bristles 3 shown in FIGS. 22 through 39 vary from 80° in the end sections 5 of the bristles 3 in FIGS. 22 through 27, to approximately 89° in the end sections 5 of the bristles 3 in FIGS. 34 through 39. Smaller wedge angles $\alpha$ between 5° and 80° are also feasible.

Figures 40, 41, 42, 43, 44, 45, 46, 47:
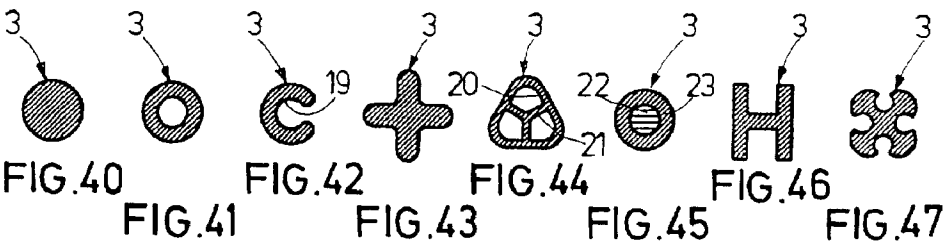

FIGS. 40 through 47 show variations of cross section shapes for the bristles 3. FIG. 40 shows the cross section of a bristle 3 of solid material. FIG. 41 shows a hollow bristle 3. FIG. 42 shows a bristle 3 with a longitudinal groove 19 and a resulting cross section shape that resembles the letter C. FIG. 43 shows a bristle 3 with a cross-shaped cross section. The bristle 3 in FIG. 44 has a triangular outer face shape with rounded edges. Inside, the bristle 3 of FIG. 44 has three hollow chambers 20 extending parallel to the longitudinal axis 12 of the bristle 3, which are separated from one another by interconnected webs 22 in the form of the letter Y. The bristle 3 according to FIG. 45 is manufactured from a compound material with a cylindrical core section 22 and a wrapper section 23 encompassing the same on the outside like a sleeve. The bristle 3 according to FIG. 46 has a cross section shape in the style of the letter H. The bristle 3 according to FIG. 47 has a cross section structure in a fourfold, cloverleaf type pattern in such a way that the bristle 3 in the section in FIG. 47 appears like a piece from a puzzle.

In the cross section geometries of the presented cross section shape variations that are not rotation symmetrical, i.e., in the cross section shapes of FIGS. 42, 43, 44 and 46, the length of the ridge can be predefined by selecting the direction of the ridge of the end edge region 8 relative to the orientation of the cross section shape, which allows the combing properties of the bristles 3 of the mascara brush 1 having this cross section shape to be predefined.

Alternately, the end edge region 8 may also be created by a single flat wedge surface that causes the end section 5 of the bristle 3 to be slanted to create an end edge region 8.

FIG. 48 shows an additional variation of the mascara brush 1. In this embodiment, bristles 3, 24 of different lengths are provided and only the end sections 5 of the longer bristles 3 have end edge regions 8. These longer bristles comb the lashes 14 within the framework of the mascara application process. The shorter bristles 24 that are not executed wedge-shaped serve to support the cleaning and application effect of the mascara brush 1.

What is claimed is:

1. A mascara brush for applying a mascara mass onto the eyelashes, comprising a plurality of bristles secured at multiple sites along a longitudinal axis of and between two twisted wire segments, the series of the plurality of bristles extending out from the two twisted wire segments, free ends of the bristles being designed tapered, wherein each of the free ends (5) of at least a portion of the bristles (3) terminate at a straight outer edge (8) wherein any longitudinal cross section perpendicular to the straight outer edge (8) and through the free ends (5) is wedge-shaped, and wherein the two twisted wire segments and a handle (4) of the brush are coaxial.

2. A mascara brush according to claim 1, wherein the free ends have a roof or chisel-shaped configuration (6 through 8).

3. A mascara brush according to claim 1, wherein the outer edge (8) of the ends (5) each extend approximately parallel to one another and substantially perpendicular to the longitudinal axis of the twisted wires (2).

4. A mascara brush according to claim 1, wherein bristles (3, 24) of different lengths are provided and only ends of longer bristles (3) are designed wedge-shaped in cross section.

5. A mascara brush according to claim 1, wherein the ends of the bristles (3) are polished.

6. A mascara brush according to claim 1, wherein a bristle diameter d in the range between 0.1 mm and 0.4 mm.

7. A mascara brush according to claim 1, wherein a wedge length L is in a range between 0.5 mm and 15 mm.

8. A mascara brush according to claim 1, wherein an angle β between the longitudinal axis (12) of the bristles (3) and longitudinal brush axis (13) of the bristles is in a range between 45° and 135°.

9. A mascara brush for applying a mascara mass onto the eyelashes, comprising a plurality of bristles secured at multiple sites along a longitudinal axis of a core, the series of the plurality of bristles extending out from the core, free ends of the bristles being designed tapered, wherein each of the free ends (5) of at least a portion of the bristles (3) terminate at a straight outer edge (8) wherein any longitudinal cross section perpendicular to the straight outer edge (8) and through the free ends (5) is wedge-shaped, and wherein the core and a handle (4) of the brush are coaxial.

10. A mascara brush according to claim 9, wherein the free ends have a roof or chisel-shaped configuration (6 through 8).

11. A mascara brush according to claim 9, wherein the outer edge (8) of the ends (5) each extend approximately parallel to one another and substantially perpendicular to the longitudinal axis of the core (2).

12. A mascara brush according to claim 9, wherein bristles (3, 24) of different lengths are provided and only ends of longer bristles (3) are designed wedge-shaped in cross section.

13. A mascara brush according to claim 9, wherein the ends of the bristles (3) are polished.

14. A mascara brush according to claim 9, wherein a bristle diameter d in the range between 0.1 mm and 0.4 mm.

15. A mascara brush according to claim 9, wherein a wedge length L is in a range between 0.5 mm and 15 mm.

16. A mascara brush according to claim 9, wherein an angle β between the longitudinal axis (12) of the bristles (3) and longitudinal brush axis (13) of the bristles is in a range between 45° and 135°.

* * * * *